US006053106A

United States Patent [19]

Sauer

[11] Patent Number: 6,053,106

[45] Date of Patent: Apr. 25, 2000

[54] METHOD AND DEVICE FOR OPTIMIZING UTILIZATION OF A DAMPENING AGENT IN OFFSET PRINTING

[75] Inventor: Klaus Sauer, Dielheim-Horrenberg, Germany

[73] Assignee: Heidelberger Druckmaschinen AG, Heidelberg, Germany

[21] Appl. No.: 09/169,062

[22] Filed: Oct. 9, 1998

[30] Foreign Application Priority Data

Oct. 14, 1997 [DE] Germany ..... 197 45 135

[51] Int. Cl.[7] ..... B41F 33/10

[52] U.S. Cl. ..... 101/484; 101/483; 101/147; 101/148

[58] Field of Search ..... 101/148, 147, 101/483, 484, DIG. 45

[56] References Cited

U.S. PATENT DOCUMENTS

| | | | |
|---|---|---|---|
| 4,151,854 | 5/1979 | Patsko | 101/147 |
| 4,570,538 | 2/1986 | Webb | 101/148 |
| 5,651,311 | 7/1997 | Lee et al. | 101/148 |
| 5,797,328 | 8/1998 | Lippold et al. | 101/483 |

FOREIGN PATENT DOCUMENTS

| | | |
|---|---|---|
| 41 29 189 | 3/1938 | Germany . |
| 40 02 401 | 11/1992 | Germany . |
| 690 10 342 | 12/1994 | Germany . |
| 195 16 213 | 11/1997 | Germany . |

*Primary Examiner*—John S. Hilten
*Assistant Examiner*—Daniel J. Colilla
*Attorney, Agent, or Firm*—Kenyon & Kenyon

[57] ABSTRACT

A method and a device (1) for carrying out the method of optimizing dampening agent utilization in offset printing with a container (2) for dampening agent (3), a supply line (4) to at least one dampening mechanism, a recirculation line (5) for the unused dampening agent and a detector for measuring the fill level (10), which is functionally linked to the shutoff (7) for the supply (6). Servicing is reduced to a minimum, the cleaning intervals are lengthened, the utilization of dampening agent is improved, and the amount to be disposed of is reduced in that the detector for measuring the fill level (10) is set so that, after closing the shutoff (7), it reopens the supply (6) only when the fill level (11, 18) has been reduced so that after refilling the container (2) the contamination level is not increased compared to the instant prior to the interruption.

18 Claims, 1 Drawing Sheet

METHOD AND DEVICE FOR OPTIMIZING UTILIZATION OF A DAMPENING AGENT IN OFFSET PRINTING

FIELD OF THE INVENTION

The present invention concerns a method for optimizing dampening agent utilization in offset printing. The present invention also concerns a device for optimizing dampening agent utilization in offset printing.

RELATED TECHNOLOGY

A dampening agent, i.e., usually water with additives, may be needed for offset printing and supplied to the individual printing groups. A container is used for this purpose, from which the dampening agent is supplied to the individual printing groups, and to which the unused dampening agent is returned from the printing groups. A circuit is thus formed which does not produce a steady stream of wastewater, and only the dampening agent consumed in the printing process, approximately 5%, has to be renewed, and the required additives also must be added to water in this proportion. The supply of this fresh dampening agent is controlled by the fact that the container has a fill level meter, for example, a float, which opens the supply when the level drops below a fill level and shuts it off the when a maximum fill level is reached. After a certain period of time, dampening agent contamination becomes too high for continued usage in the printing process. Then the container must be emptied and the contaminated dampening agent disposed of as special waste. Such disposal is increasingly expensive, with labor and machine downtime representing additional cost factors.

German Patent Application No. 195 16 213 A1 discloses a method of optimizing dampening agent utilization in offset printing, in which the supply of fresh dampening agent to a container, from which the printing press is supplied and into which the unused dampening agent is recirculated, is interrupted from time to time during the printing operation. Also disclosed is a device for optimizing dampening agent utilization in offset printing having a container for the dampening agent, a supply line to at least one dampening mechanism, a recirculation line for unused dampening agent and a means for detecting the fill level, which is functionally connected to a shutoff for a supply of fresh dampening agent. This document proposes that the container be filled only to a reduced upper fill level during a period prior to the end of the printing operation. In this way, when the printing operation is completed, the amount of dampening agent to be disposed of or prepared is somewhat reduced, but the amounts to be disposed of are still considerable. Another disadvantage of this proposal is that the degree of contamination must be continuously evaluated by the printer on the basis of experience or by testing the dampening agent, and the dampening agent must be disposed of when a degree of contamination has been reached, which would impair the printing process if it increased any further. The utilization of dampening agent is barely improved by this proposal, and the problem that some dampening agent must be continuously disposed of is not solved. In addition, the uncertainty about the time when an excessive contamination level is reached is not eliminated. Servicing is required in short intervals, and the dampening agent in the container is rather prematurely changed, usually after the printing operation is completed, and the container is cleaned, in order not to risk interruption in the next printing job.

These problems are further exacerbated by the fact that today the addition of alcohol to the dampening agent must be gradually eliminated for environmental reasons. This results in the printing process responding to contamination of the dampening agent in a much more sensitive manner, and the tolerable degree of contamination only amounts to a fraction of what could be allowed with a dampening agent containing an alcohol additive.

SUMMARY OF THE INVENTION

An object of the present invention is to provide a method and a device for optimizing dampening agent utilization in offset printing with a container for the dampening agent, in which servicing is reduced to a minimum, cleaning intervals are lengthened, utilization of the dampening agent is improved, and the amount of dampening agent to be disposed of is diminished.

Concerning the present method, this objective may be achieved by the fact that the interruption in the supply of fresh dampening agent, during which the printing operation is continued, has a duration such that after the container is refilled, the amount of contamination does not increase compared to that existing at the instant prior to the interruption.

Concerning the device, the objective may be achieved by the fact that a detector for detecting the fill level is settable so that, after the supply is shut off, it is not reopened until the fill level has decreased to the point that after the container is refilled the contamination level does not increase compared to that existing at the instant prior to the interruption.

With the present invention, continuous monitoring of the contamination level in the dampening agent is no longer required; it is sufficient to check the device from time to time for proper operation. The need for premature changing of dampening agent at the end of each printing job is eliminated. It is sufficient to clean the container and dispose of the dampening agent when an interfering amount of sludge builds up on the bottom of the container. In this manner, the amount of dampening agent to be disposed of is considerably reduced, labor time is saved, and machine downtime is avoided, which represents a high cost factor, especially in the case of machines working in multi-shift operation.

The present invention is based on the fact that contamination in the dampening agent is only disadvantageous starting from a certain level of contamination. This leads to the conclusion that, if the supply of fresh dampening agent is interrupted during the use of the dampening agent in the container it is possible to "consume by printing" the contaminating particles together with the dampening agent. Thus the dampening agent amount is reduced so that, after the container is refilled, the degree of contamination is not increased, or is even diminished compared to that prevailing at the time of the interruption. This sequence can be repeated until a sludge deposit that must be removed is formed in the container. Thus, instead of continuous disposal of the dampening agent, it is consumed with the above advantages.

The container can be cleaned and the contaminated dampening agent can be disposed of at a time when the machine is not being used and manpower is available for cleaning or when the machine is cleaned anyway. Such cleaning with disposal of the dampening agent still in the container is conveniently performed only when the fill level reaches minimum, since the amount to be disposed of is the least then. The latest point in time for container cleaning is the time when a sludge deposit on the bottom attains a thickness such that there is a risk of it being entrained in the dampening agent traveling to the printing group.

The aforementioned interruption in the supply of fresh dampening agent may take place after each filling to the maximum fill level. Therefore, a relatively constant fill level is not achieved by filling to the maximum fill level after a relatively moderate reduction in the fill level, as was customary previously, but so much dampening agent is used that a continuous renewal process is achieved by refilling. Thus servicing is reduced to function monitoring and the infrequent removal of the sludge deposit. Concerning the present device, this is achieved by functionally linking the detector for detecting the fill level with the shutoff device so that reduction in the fill level is triggered each time the maximum level is reached.

Another possibility is for such an interruption to take place only if the contamination level approaches a critical value at which the printing quality is affected. This can be achieved by automatically detecting the contamination level of the dampening agent and interrupting the supply of fresh dampening agent as a function of a settable contamination level. The settable contamination level is selected so that when a minimum fill level is reached, the maximum contamination concentration allowable for the printing process is still not exceeded. The dampening agent present is consumed to the minimum fill level and then refilled with fresh dampening agent to the maximum fill level, whereby the renewal process is equally achieved.

Concerning the present device, this mode of operation is achieved by providing the container with a sensor for measuring the contamination of the dampening agent, which is connected to an information processor, which causes the supply to be shut off only when a settable degree of contamination is reached and until a minimum fill level is reached. The degree of contamination is set in the manner described above. The information processor can be connected to a float of the usual type, such as used for the fill level in normal operation, i.e., it opens the supply of fresh dampening agent at a lower fill level and shuts it off at a maximum fill level. Such a fill level meter, or a similar one, is modified in that, when the amount of dampening agent is reduced in the container, instead of opening the supply at the lower fill level of normal operation, it only opens when the minimum fill level is reached. This means that the float is provided with a third, lower switching position.

Thus, countermeasures against an excessive degree of contamination are taken only when they are needed, while a measurement of the degree of contamination is taking place simultaneously. This measurement provides the printer with reliable control over dampening agent contamination and thus over proper operation. This fill level control initially has normal operation as known from the related art with a relatively constant fill level, this normal operation being only interrupted for the necessary renewal of dampening agent. The degree of contamination at which this measure is initiated depends on the machine, the composition of the dampening agent and the characteristics of the printing job. It can be determined empirically, calculated using a program or it may depend on empirical values determined by the operator. It is essential here that the maximum allowable contaminant concentration not be exceeded when the minimum fill level is reached. For this purpose, the information processor is set up so that the supply of fresh dampening agent is interrupted at such a contamination level that when a minimum fill level is reached, the maximum allowable contamination concentration is not yet reached.

The optimum configuration of this dampening agent contamination level reduction is achieved when there is a great difference between the fill level in normal operation and the minimum fill level. The minimum fill level can be relatively low, but it should not result in interruption in the dampening agent supply or entrainment of sludge. Therefore, the minimum fill level is advantageously only a fraction of the fill level in normal operation. Accordingly, there is a great reduction in contamination level when the container is refilled after reaching the minimum fill level. For example, if the minimum fill level is one-fifth of the full level in normal operation, this measure causes the contamination level to be reduced to one-fifth through the supply of fresh dampening agent when the normal operation fill level is reached again.

Different options are available for measuring the contamination level in the dampening agent: the electrical conductivity or the pH value can be measured. For an accurate determination of the contamination level, it is however recommended that both values be measured. Of course, other possibilities for determining the contamination level also exist, for example, by measuring the concentration of certain chemical components, which become enriched as a result of dampening agent contamination. The device therefore has a sensor set up to measure electrical conductivity, pH value and/or similar values.

In determining values used as a measure of contamination, it must be taken into account that the dampening agent is water with additives, which are determined together with the measured values. It is therefore proposed that, in order to associate the degree of contamination with a measurable value, in particular to associate a value with the degree of contamination at which the supply of fresh dampening agent must be interrupted, these values are initially measured for fresh dampening agent, and are then associated with the "no contaminant" condition. Then the values are added that correspond to the contamination at which the dampening agent supply can be consumed to a minimum fill level without affecting printing quality. The sum is associated with the "maximum allowable contamination" condition.

An additional sensor can be provided, which indicates when an amount of sludge has accumulated in the container at which time it must be promptly emptied and cleaned. Thus it is achieved that in normal operation no checking is needed, but the signal of the additional sensor can be awaited before service work is undertaken upon reaching one of the next minimum fill levels.

For simple control, a display may be used to indicate all the above-mentioned values and/or operating states or a selection thereof. The information processor can be a mechanical or electromechanical, however, most conveniently a suitably set up computer. The press and printing job parameters, as well as the dampening agent composition, can be entered in this computer to calculate the relevant values, or it is possible to store measured values. The computer can also be the control computer of the printing press.

BRIEF DESCRIPTION OF THE DRAWING

Two embodiments of the device according to the present invention are elucidated with reference to the drawing, in which.

DETAILED DESCRIPTION

Figure 1:
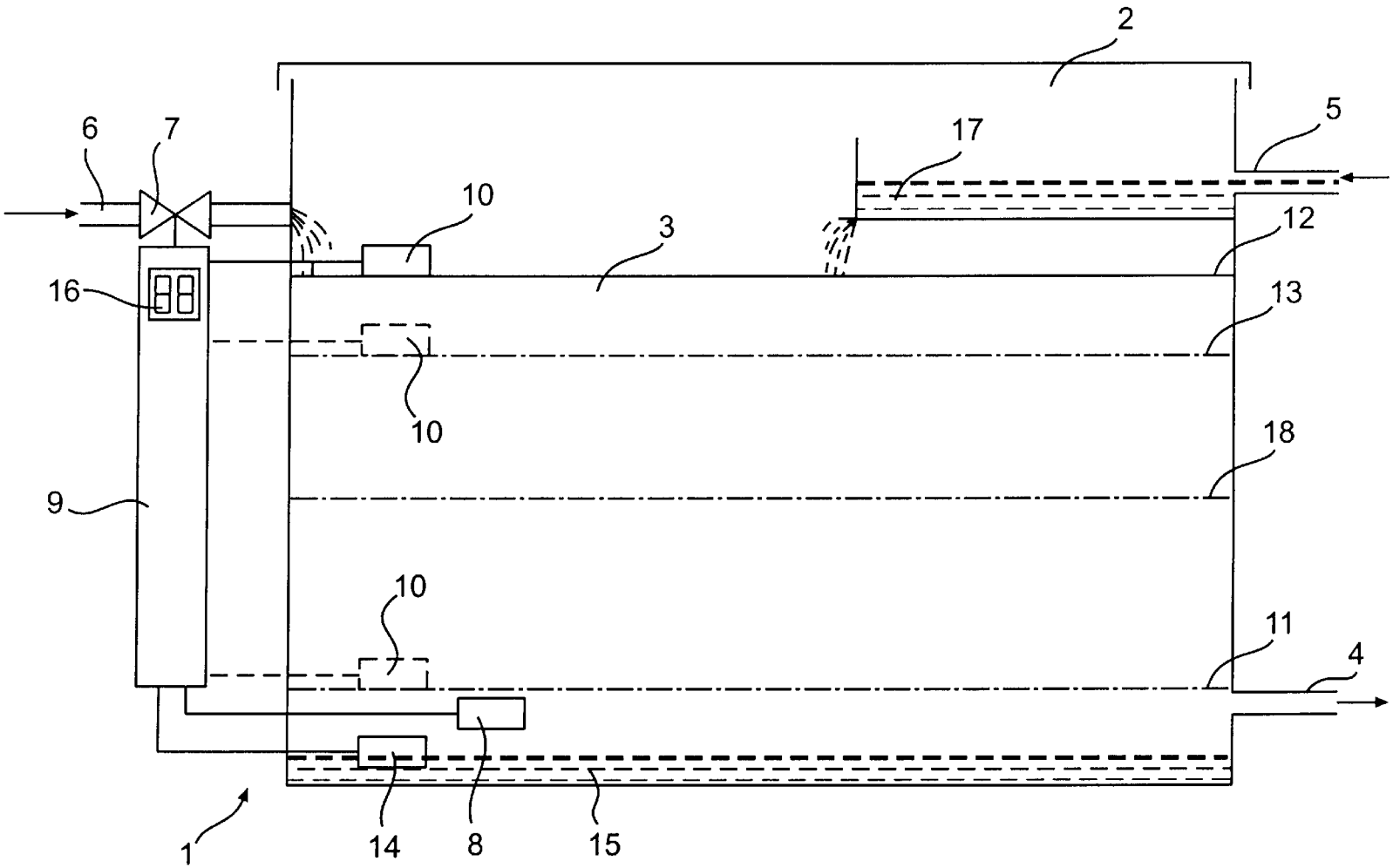
FIG. 1 shows a device according to the present invention, and illustrates how related art devices functioned.

Device 1 has a container 2, from which one or more printing groups of a printing press are supplied with dampening agent 3. Lines 4 serve this purpose. Dampening agent 3 not consumed in the printing groups is recirculated via recirculating lines 5 into container 2, with part of the entrained contaminants being retained in filter 17.

As with related art devices, device 1 is equipped with a detector 10 for detecting the fill level, for example, with floats. In the related art the floats were responsible for maintaining a relatively constant fill level 12, 13 during normal operation. The fill level in these related art devices fluctuated between a lower fill level 13 and a maximum fill level 12, with float 10 opening shutoff 7 of fresh dampening agent supply 6 upon reaching lower fill level 13 and shutting off the supply upon reaching maximum fill level 12. Since the dampening agent returning via recirculating line 6 contains contaminants, the degree of contamination in such a related device would increase gradually in container 2 until dampening agent 3 reached a degree of contamination that made its further use impossible without affecting the printing process. Then container 2 had to be emptied and contaminated dampening agent 3 had to be disposed of.

In one embodiment of the present invention, the detector for measuring the fill level, for example, float 10, shuts off supply 6 not at the previously customary lower fill level 13 of "normal operation," which is relatively close to maximum fill level 12, but only at a reduced fill level 18. The reduction of fill level 18 in this case must be such that after refilling container 2 to its maximum fill level 12, the contamination level of dampening agent 3 diminishes, or at least does not increase, compared to the contamination level at reduced till level 18.

A second embodiment of the present invention proposes that container 1 be equipped with a sensor 8 for measuring contamination in dampening agent 3. The conductivity of dampening agent 3 is measured using this sensor 8, and the measured values—taking the conductivity of fresh dampening agent into account—can be associated with a certain degree of contamination. The values are forwarded to an information processor 9, preferably a computer. A value at which shutoff 7 of supply 6 is closed is entered in this computer 9 or it contains a program for calculating the same. This value corresponds to a degree of contamination of dampening agent 3 at which it is still possible to consume dampening agent 3 down to a minimum fill level 11 without the increasing contamination reaching a level at which the printing process is affected.

After reaching minimum fill level 11, shutoff 7 of supply 6 is opened and container 2 is filled with fresh dampening agent until the maximum fill level 12 is reached. Since the relatively highly contaminated but small amount of remainder still present at minimum fill level 11 is diluted to a multiple by filling container 2, the degree of contamination is reduced so that device 1 can continue operating normally. Filling oscillates, as described above, between lower fill level 13 and maximum fill level 12 until the input value is reached again and a new fill level reduction is initiated.

The embodiment illustrated furthermore has an additional sensor 14 in the proximity of the bottom of container 2, which indicates when a sludge deposit 15 has formed in container 2, at which point container 2 must be promptly emptied and cleaned. In addition, computer 9 is also equipped with a display 16, which indicates all the relevant values and/or operating states to the operator.

What is claimed is:

1. A method of optimizing dampening agent utilization in offset printing by a printing press comprising:

providing a supply of fresh dampening agent to a container;

supplying the printing press with dampening agent in the container;

recirculating unused dampening agent to the container;

interrupting the providing of the supply of fresh dampening agent for at least one interruption period during a printing operation of the printing press upon reaching a pre-set reduced fill level, the dampening agent in the container having a first contamination level at an instant prior to the interruption period; and refilling the container to a maximum fill level with the fresh dampening agent, when reaching a minimum fill level upon termination of the interruption period, the container having a second contamination level after the refilling, the reduced fill level and the minimum fill level being such that the second contamination level is not greater than the first contamination level.

2. The method as recited in claim 1 wherein the at least one interruption period takes place after each filling or refilling of the container to the maximum fill level.

3. The method as recited in claim 1 wherein the at least one interruption period only takes place when a general contamination level in the container approaches a critical level, and wherein the printing quality of the printing press is affected at the critical level.

4. The method as recited in claim 3 further comprising measuring the general contamination level in the container automatically and wherein the interrupting the supply of fresh dampening agent is a function of a settable degree of contamination, the settable degree of contamination being selected so that, when the minimum fill level is reached, a maximum allowable contamination concentration for the printing operation is not exceeded.

5. The method as recited in claim 4 wherein the minimum fill level is substantially less than the maximum fill level of the container.

6. The method as recited in claim 1 wherein contaminated dampening agent is disposed of only at the minimum fill level when a sludge deposit is to be removed from the container.

7. The method as recited in claim 4 further comprising measuring the general contamination level via an electrical conductivity of dampening agent in the container.

8. The method as recited in claim 4 further comprising measuring the general contamination level via a pH value of dampening agent in the container.

9. The method as recited in claim 4 wherein in order to associate a value with the general contamination level at which the supply of fresh dampening agent should be interrupted, an initial value is measured for the fresh dampening agent and then other values are added to the initial value corresponding to a level of contamination at the minimum fill level without printing quality being affected.

10. A device for optimizing utilization of a dampening agent in offset printing comprising:

a container for the dampening agent;

an outlet line connected to at least one dampening mechanism;

a recirculation line for unused dampening agent;

a supply of fresh dampening agent;

a shutoff for the supply;

a settable detector for detecting a fill level of the dampening agent in the container, the detector being functionally linked to the shutoff; and an information processor adapted for setting the detector to a reduced fill level and for controlling the shutoff so that, after the supply is closed by the shutoff upon reaching the reduced fill level so as to create an interruption, the supply is not opened again to refill the container until a fill level has been reduced to a minimum fill level, wherein a second contamination level of the dampening agent after refilling of the container to a maximum fill level is not greater than a first contamination level at the reduced fill level, and wherein the maximum fill level is greater than the reduced fill level, which is greater than the minimum fill level.

11. The device as recited in claim 10 further comprising an electrical linkage between the detector and the shutoff adapted to close the shutoff each time the maximum fill level is sensed by the detector.

12. The device as recited in claim 10 wherein the container includes a sensor for measuring the contamination level of the dampening agent, the sensor being connected to the information processor for causing the supply to be shut off only upon reaching a settable degree of contamination and the minimum fill level.

13. The device as recited in claim 12 wherein the information processor is calibrated so that the supply of fresh dampening agent is interrupted at a degree of contamination of the dampening agent in the container such that a minimum allowable contamination concentration for a printing process is not exceeded when the minimum fill level is reached.

14. The device as recited in claim 12 wherein the minimum fill level is substantially less than the maximum fill level of the container.

15. The device as recited in claim 12 wherein the sensor is an electrical resistance sensor.

16. The device as recited in claim 12 wherein the sensor is a pH sensor.

17. The device as recited in claim 10 further comprising a deposit sensor for indicating when a predetermined level of a sludge deposit has accumulated in the container.

18. The device as recited in claim 10 further comprising a display.

* * * * *